US010301053B2

(12) United States Patent
Xu et al.

(10) Patent No.: US 10,301,053 B2
(45) Date of Patent: May 28, 2019

(54) AUTOMATIC LABELING APPARATUS AND METHOD AND ASSEMBLY JIG AND METHOD

(71) Applicants: BOE TECHNOLOGY GROUP CO., LTD., Beijing (CN); HEFEI BOE DISPLAY LIGHTING CO., LTD., Hefei, Anhui (CN)

(72) Inventors: Yeshun Xu, Beijing (CN); Wenbo Sun, Beijing (CN); Yanfeng Li, Beijing (CN); Xing Wang, Beijing (CN)

(73) Assignees: BOE TECHNOLOGY GROUP CO., LTD., Beijing (CN); HEFEI BOE DISPLAY LIGHTING CO., LTD., Hefei, Anhui (CN)

( * ) Notice: Subject to any disclaimer, the term of this patent is extended or adjusted under 35 U.S.C. 154(b) by 38 days.

(21) Appl. No.: 15/537,758

(22) PCT Filed: Jun. 24, 2016

(86) PCT No.: PCT/CN2016/086988

§ 371 (c)(1),
(2) Date: Jun. 19, 2017

(87) PCT Pub. No.: WO2017/152542

PCT Pub. Date: Sep. 14, 2017

(65) Prior Publication Data

US 2018/0044048 A1 Feb. 15, 2018
US 2018/0297735 A9 Oct. 18, 2018

(30) Foreign Application Priority Data

Mar. 10, 2016 (CN) ..... 2016 1 0136583

(51) Int. Cl.

*B65C 1/02* (2006.01)
*B65C 9/08* (2006.01)
*B65C 9/18* (2006.01)
(Continued)

(52) U.S. Cl.

CPC ..... *B65C 9/18* (2013.01); *B65C 1/021* (2013.01); *B65C 1/028* (2013.01); *B65C 9/08* (2013.01);
(Continued)

(58) Field of Classification Search

CPC ..... B65C 1/021; B65C 1/028; B65C 9/08; B65C 9/18; B65C 9/1865; B65C 9/26; B65C 9/36; B65C 9/1884; Y10T 156/17
(Continued)

(56) References Cited

U.S. PATENT DOCUMENTS 3,985,605 A * 10/1976 Treiber ..... B65C 1/021 156/384
4,685,702 A * 8/1987 Kazuharu ..... B41J 3/4075 235/375

FOREIGN PATENT DOCUMENTS

CN 2077851 U 5/1991
CN 2183337 Y 11/1994
(Continued)

OTHER PUBLICATIONS

English translation of written opinion of PCT/CN2016/086988.*
(Continued)

*Primary Examiner* — Sonya M Sengupta
(74) *Attorney, Agent, or Firm* — Armstrong Teasdale LLP

(57) ABSTRACT

The present disclosure provides an automatic labeling apparatus and method, as well as an assembly jig and method, the automatic labeling apparatus includes an attachment platform provided with an attachment surface, an attachment unit provided with a label receiving surface, and a separation unit, wherein the separation unit is configured to separate a label from a label base paper to the label receiving surface with a glue surface of the label away from the label receiving surface, the label receiving surface being configured to make
(Continued)

the glue surface of the label higher than the attachment surface when the label is on the label receiving surface.

19 Claims, 4 Drawing Sheets

(51) Int. Cl.
*B65C 9/26* (2006.01)
*B65C 9/36* (2006.01)

(52) U.S. Cl.
CPC ..... *B65C 9/1865* (2013.01); *B65C 9/26* (2013.01); *B65C 9/36* (2013.01); *B65C 9/1884* (2013.01); *Y10T 156/17* (2015.01)

(58) Field of Classification Search
USPC ..... 156/238, 364, 443, 494, 538, 247
See application file for complete search history.

(56) References Cited

FOREIGN PATENT DOCUMENTS

| | | | |
|---|---|---|---|
| CN | 1276766 | A | 12/2000 |
| CN | 101445166 | A | 6/2009 |
| CN | 103350805 | A | 10/2013 |
| CN | 203402431 | U | 1/2014 |
| CN | 104044782 | A | 9/2014 |
| CN | 204096187 | U | 1/2015 |
| CN | 204776366 | U | 11/2015 |
| CN | 105584698 | A | 5/2016 |
| CN | 205396760 | U | 7/2016 |
| DE | 29915598 | U1 | 3/2001 |
| JP | H04142243 | A | 5/1992 |
| JP | 2003081232 | A | 3/2003 |
| JP | 2007008488 | A | 1/2007 |
| TW | M295036 | U | 8/2006 |

OTHER PUBLICATIONS

English translation of CN101445166.*
English translation of ISR of PCT/CN2016/086988.*
English translation of PCT (CN) International Search Report, Application No. PCT/CN2016/086988, dated Dec. 14, 2016, 3 pgs.
PCT (CN) Written Opinion, Application No. PCT/CN2016/086988, dated Dec. 14, 2016, 7 pgs.: with English translation.
China First Office Action, Application No. 201610136583.X, dated Jun. 28, 2017, 33 pgs.: with English translation.

* cited by examiner

AUTOMATIC LABELING APPARATUS AND METHOD AND ASSEMBLY JIG AND METHOD

CROSS REFERENCE TO RELATED APPLICATIONS

This patent application is a National Stage Entry of PCT/CN2016/086988 filed on Jun. 24, 2016, which claims the benefit and priority of Chinese Patent Application No. 201610136583.X filed on Mar. 10, 2016, the disclosures of which are incorporated by reference herein in their entirety as part of the present application.

BACKGROUND

Embodiments of the present disclosure relate to an automatic labeling apparatus and method, as well as an assembly jig and method.

There are currently two ways to label a product such as a back plate of a backlight: manual labeling and machine labeling.

Manual labeling: the use of manual labeling wastes human resources, the efficiency is very low, and there will be poor qualities such as artificially missing, wrong attachment, skew attachment, etc.

Automatic machine labeling: the use of machine labeling requires an automatic labeling machine and dedicated assembly line card slot equipment to be set up. When operating, the automatic labeling machine needs to first suck a label from a label roll through a robot arm of the machine to a suction nozzle of the robot arm, turn the robot arm, and press the sucked label down on a back plate to complete the labeling operation. Automatic labeling machine is more expensive, and automatic labeling machine can only be used for labeling, cannot be used for other purposes at the same time On the other hand, an assembly jig is used for assembling products such as display modules of smart phones, tablet computers. The existing assembly jig has only a single function, and it is difficult to track the operation quality of each assembly staff.

It will be appreciated that there is a need in the art for an improved automated labeling apparatus and assembly jig.

BRIEF DESCRIPTION

One aspect of the present disclosure provides an automatic labeling apparatus including an attachment platform provided with an attachment surface, an attachment unit provided with a label receiving surface, and a separation unit, wherein the separation unit is configured to separate a label from a label base paper to the label receiving surface with a glue surface of the label away from the label receiving surface, the label receiving surface being configured to make the glue surface of the label higher than the attachment surface when the label is on the label receiving surface.

According to an exemplary embodiment of the present disclosure, the automatic labeling apparatus further includes a conveying unit configured to sequentially convey labels in a label roll to the separation unit.

According to a further exemplary embodiment of the present disclosure, the conveying unit includes a label roll turning wheel configured to be mounted with a label roll and to be driven to rotate, and a label base paper reclaiming wheel configured to reclaim the label base paper of the label roll by rotation, and to convey labels in the label roll to the separation unit sequentially.

According to an exemplary embodiment of the present disclosure, the separation unit includes a label base paper baffle configured to cause the label base paper on the label roll to turn back when the label base paper reclaiming wheel rotates, so that an individual label is separated from the label base paper to the label receiving surface.

According to an exemplary embodiment of the present disclosure, the attachment unit includes a label top tray on which the label receiving surface is provided for receiving an individual label.

According to a further exemplary embodiment of the present disclosure, the attachment unit further includes a spring located below the label top tray and configured to support the label top tray.

According to an exemplary embodiment of the present disclosure, the label top tray and the separation unit are located below the attachment surface, and the apparatus further includes a first detector configured to detect whether a label is present in the label top tray, a first control module connected to the first detector and a driver for driving the label top tray, and configured to control the driver for driving the label top tray to raise the label top tray so that the glue surface of the label in the label top tray is higher than the attachment surface when the first detector detects a label present in the label top tray, and control the driver for driving the label top tray to lower the label top tray so as to receive a next label when the first detector detects no label in the label top tray.

According to a further exemplary embodiment of the present disclosure, the apparatus further includes a label retaining wall disposed near the label top tray and configured to stop further movement of an individual label after the individual label is separated from the label base paper.

According to another exemplary embodiment of the present disclosure, the label top tray and the separation unit are located above the attachment surface.

According to a further exemplary embodiment of the present disclosure, the label top tray is provided with a plurality of positioning air holes thereon for holding an individual label in place when the individual label is on the top of the label.

According to a further exemplary embodiment of the present disclosure, the attachment unit further includes left and right stoppers provided at the label entrance end of the label top tray, and configured to position a label in a left and right direction.

According to an exemplary embodiment of the present disclosure, the automatic labeling apparatus further includes a second detector configured to detect whether a label is present in the label top tray, a second control module connected to the second detector and the motor for driving the conveying unit, and configured to control the motor to drive the conveying unit so that a next label is placed in the label top tray when the second detector detects no label present in the label top tray.

According to an exemplary embodiment of the present disclosure, the automatic labeling apparatus further includes a label support configured to provide support during movement of a label.

According to an exemplary embodiment of the present disclosure, the automatic labeling apparatus further includes a label reader configured to read information of the label.

According to a further exemplary embodiment of the present disclosure, a reading port of the label reader is provided on the label receiving surface.

According to an exemplary embodiment of the present disclosure, the attachment platform is an operating platform of an assembly jig, the attachment surface being an operating surface of the operating platform.

In another aspect of the present disclosure, there is also provided an assembly jig including an automatic labeling apparatus according to any one of the preceding embodiments.

In still another aspect of the present disclosure, there is also provided an automatic labeling method including separating a label from a label base paper to a label receiving surface by a separation unit with a glue surface of the label away from the label receiving surface and the glue surface of the label being higher than an attachment surface of an attachment platform, so that when a product is placed on the attachment platform, the label is automatically attached to the product through its glue surface.

According to an exemplary embodiment of the present disclosure, the method further includes conveying labels in a label roll sequentially to the separation unit by a conveying unit.

According to a further exemplary embodiment of the present disclosure, conveying labels in a label roll sequentially to the separation unit by a conveying unit includes reclaiming a label base paper of a label roll mounted on a label roll turning wheel by a label base paper reclaiming wheel by rotation, and conveying labels in the label roll to the separation unit sequentially.

According to a further exemplary embodiment of the present disclosure, separating a label from a label base paper to a label receiving surface by a separation unit includes causing the label base paper on the label roll to turn back by a label base paper baffle when the label base paper reclaiming wheel rotates, so that an individual label is separated from the label base paper to the label receiving surface.

According to a further exemplary embodiment of the present disclosure, the label receiving face is provided on a label top tray.

According to a further exemplary embodiment of the present disclosure, the method further includes supporting the label top tray by a spring located below the label top tray.

According to an exemplary embodiment of the present disclosure, the label top tray and the separation unit are located below the attachment surface, and the method further includes controlling a driver for driving the label top tray to raise the label top tray so that the glue surface of the label in the label top tray is higher than the attachment surface when detecting a label present in the label top tray, and controlling the driver for driving the label top tray to lower the label top tray so as to receive a next label when detecting no label in the label top tray.

According to a further exemplary embodiment of the present disclosure, the method further includes stopping further movement of an individual label by a label retaining wall disposed near the label top tray after the individual label is separated from the label base paper.

According to another exemplary embodiment of the present disclosure, the label top tray and the separation unit are located above the attachment surface.

According to a further exemplary embodiment of the present disclosure, the method further includes holding an individual label in place when the individual label is on the label top tray by a plurality of positioning air holes provided on the label top tray.

According to an exemplary embodiment of the present disclosure, the method further includes positioning a label in a left and right direction by left and right stoppers provided at the label entrance end of the label top tray.

According to an exemplary embodiment of the present disclosure, the method further includes detecting whether a label is present in the label top tray, and controlling a motor for driving a conveying unit to drive the conveying unit to place a next label in the label top tray by a control module connected to the motor when detecting no label present in the label top tray.

According to an exemplary embodiment of the present disclosure, the method further includes reading information of the label by a label reader.

According to an exemplary embodiment of the present disclosure, the attachment platform is an operating platform of assembly jig, the attachment surface being an operating surface of the operating platform.

Another aspect of the present disclosure provides an assembly method including an automatic labeling method according to any one of the above embodiments.

The automatic labeling apparatus according to embodiments of the present disclosure separates a label from the label base paper to the label receiving surface and causes the glue surface of the label to be higher than the attachment surface of the attachment platform so that when a product is placed on the attachment surface, through the gravity of the product or a placement pressure, the label can be automatically attached to the product, thus providing an automatic labeling apparatus of a low cost and simple operation. In addition, in some embodiments of the present disclosure, the attachment platform may be an operating platform of an assembly jig, the attachment surface being the operating surface of the operating platform, that is, the automatic labeling apparatus and the assembly jig are integrated so that the existing assembly jig is improved so that labels can be automatically attached while assembling a product, and the labels can also be traced back to the quality of operation of each assembly staff.

DETAILED DESCRIPTION

In order to provide a better understanding of the solution of the present disclosure to those skilled in the art, an automatic labeling apparatus and method, as well as the assembly jig and method provided by embodiments of the present disclosure will now be described in further detail with reference to the accompanying drawings and specific embodiments of the present disclosure. Obviously, the described embodiments are part of the present disclosure, not all embodiments. All other embodiments obtained by one of ordinary skill in the art based on the described embodiments of the disclosure without the need for creative work are within the scope of the present disclosure are within the scope of protection of the present disclosure.

Figure 1:
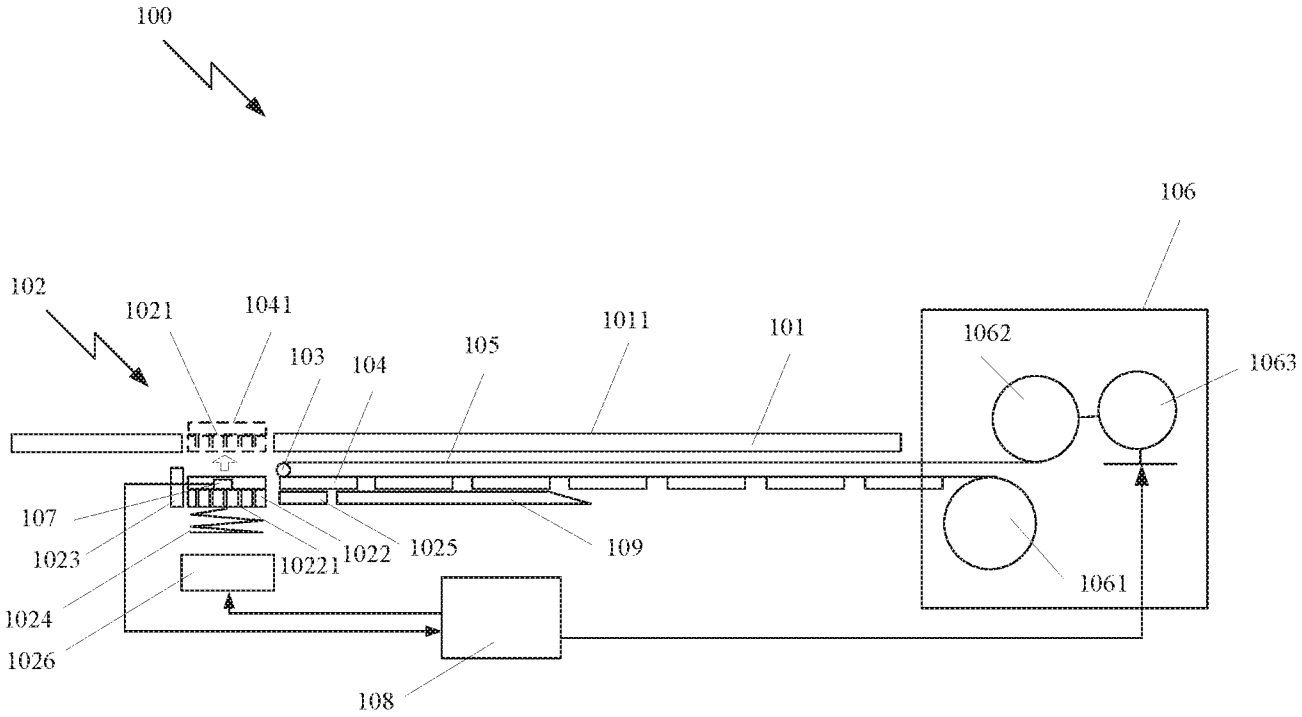
FIG. 1 shows a schematic structural view of an automatic labeling apparatus according to an embodiment of the present disclosure.

Referring now to FIG. 1, there is shown a schematic structural view of an automatic labeling apparatus 100 according to an embodiment of the present disclosure. As shown in FIG. 1, the automatic labeling apparatus 100 includes an attachment platform 101 provided with an attachment surface 1011, an attachment unit 102 provided with a label receiving surface 1021, and a separation unit 103, wherein the separation unit 103 is configured to separate a label 104 from a label base paper 105 to the label receiving surface 1021 with the glue surface 1041 of the label 104 away from the label receiving surface 1021, and the label receiving surface 1021 is configured such that when a label 104 is present on the label receiving surface 1021, the glue surface 1041 of the label 104 is higher than the attachment surface 1011. Since the glue surface 1041 of the label 104 is higher than the attachment surface 1011, the label is automatically attached to the bottom of a product when the product is placed on the attachment surface 1011 by means of the gravity or placement pressure of the product itself, thus realizing an automatic labeling apparatus with a low-cost and simple operation.

According to an exemplary embodiment of the present disclosure, the automatic labeling apparatus further includes a conveying unit 106 configured to sequentially convey labels 104 in a label roll to the separation unit 103.

Since the automatic labeling apparatus according to an exemplary embodiment of the present disclosure can realize the automatic and sequential affixing of the labels in a label roll to the products placed on the attachment platform, it is possible to realize the tracking of different attachment platforms and operators, thus facilitating the management of the operation qualities of the attachment platforms and the operators.

According to an exemplary embodiment of the present disclosure, the conveying unit 106 includes a label roll turning wheel 1061 configured to be mounted with a label roll and to be driven to rotate, and a label base paper reclaiming wheel 1062 configured to reclaim the label base paper of the label roll by rotation, and to convey the labels in the label roll to the separation unit sequentially. The label base paper reclaiming wheel 1062 may, for example, be driven to rotate by a motor 1063. As will be appreciated by those skilled in the art, the conveying unit 106 may also have various other embodiments and any embodiment of the conveying unit 106 is within the spirit and scope of the disclosure as long as it can realize that labels 104 in the label roll are sequentially delivered to the separation unit 103.

According to an exemplary embodiment of the present disclosure, the separation unit 103 includes a label base paper baffle configured to cause the label base paper 105 on the label roll to turn back when the label base paper reclaiming wheel 1062 rotates, so that an individual label 104 is separated from the label base paper 105 to the label receiving surface 1021. The turning back may, for example, be a turning back of 180°. As will be appreciated by those skilled in the art, the separation unit 103 may also have various other embodiments and any embodiment of the separation unit 103 is within the spirit and scope of the present disclosure, as long as it can realize that labels 104 are separated from the label base paper 105 to the label receiving surface 1021 with the glue surfaces 1041 of the labels 104 away from the label receiving surface 1021.

In the exemplary embodiment of the present disclosure, the quick separation of labels 104 is achieved by the cooperation of the separation unit 103 with the conveying unit 106, ensuring the continuity of conveying labels 104 and separating labels 104, and a simple structure.

According to an exemplary embodiment of the present disclosure, the attachment unit 102 includes a label top tray 1022 with the label receiving surface 1021 for receiving an individual label provided on the label top tray 1022.

According to an exemplary embodiment of the present disclosure, the attachment unit 102 further includes a spring 1024 located below the label top tray 1022 for supporting the label top tray 1022. By providing the spring 1024 such that when not pressed, the glue surface 1041 of the label 104 on the receiving surface 1021 is higher than the attachment surface 1011, and when a product is placed on the attachment surface 1011, the height of the glue surface 1041 of the label 104 is reduced by gravity of the product itself or the placement pressure to the attachment surface 1011, preventing the label 104 from being damaged at excessively large pressure, but still tightly attached to the bottom surface of the product by the spring support of the spring 1024.

According to an exemplary embodiment of the present disclosure, the label top tray 1022 and the separation unit 103 are located below the attachment surface 1011, and the apparatus 100 further includes a first detector 107 configured to detect whether or not a label 104 is present in the label top tray 1022, and a first control module 108 connected to the first detector 107 and a driver 1026 for driving the label top tray, and configured to control the driver 1026 for driving the label top tray 1022 to raise the label top tray 1022 so that the glue surface 1041 of the label 104 in the label top tray 1022 is higher than the attachment surface 1011 when the first detector 107 detects a label 104 present in the label top tray 1022, and control the driver 1026 for driving the label top tray 1022 to lower the label top tray 1022 so as to receive a next label 104 when the first detector 107 detects no label 104 in the label top tray 1022. The driver 1026 may be any drive mechanism that is capable of driving the label top tray 1022 to move upwards and downwards under the control of the first control module 108.

According to a further exemplary embodiment of the present disclosure, the apparatus 100 further includes a label retaining wall 1023 disposed near the label top tray 1022 and configured to stop further movement of an individual label after the individual label is separated from the label base paper.

Figure 2:
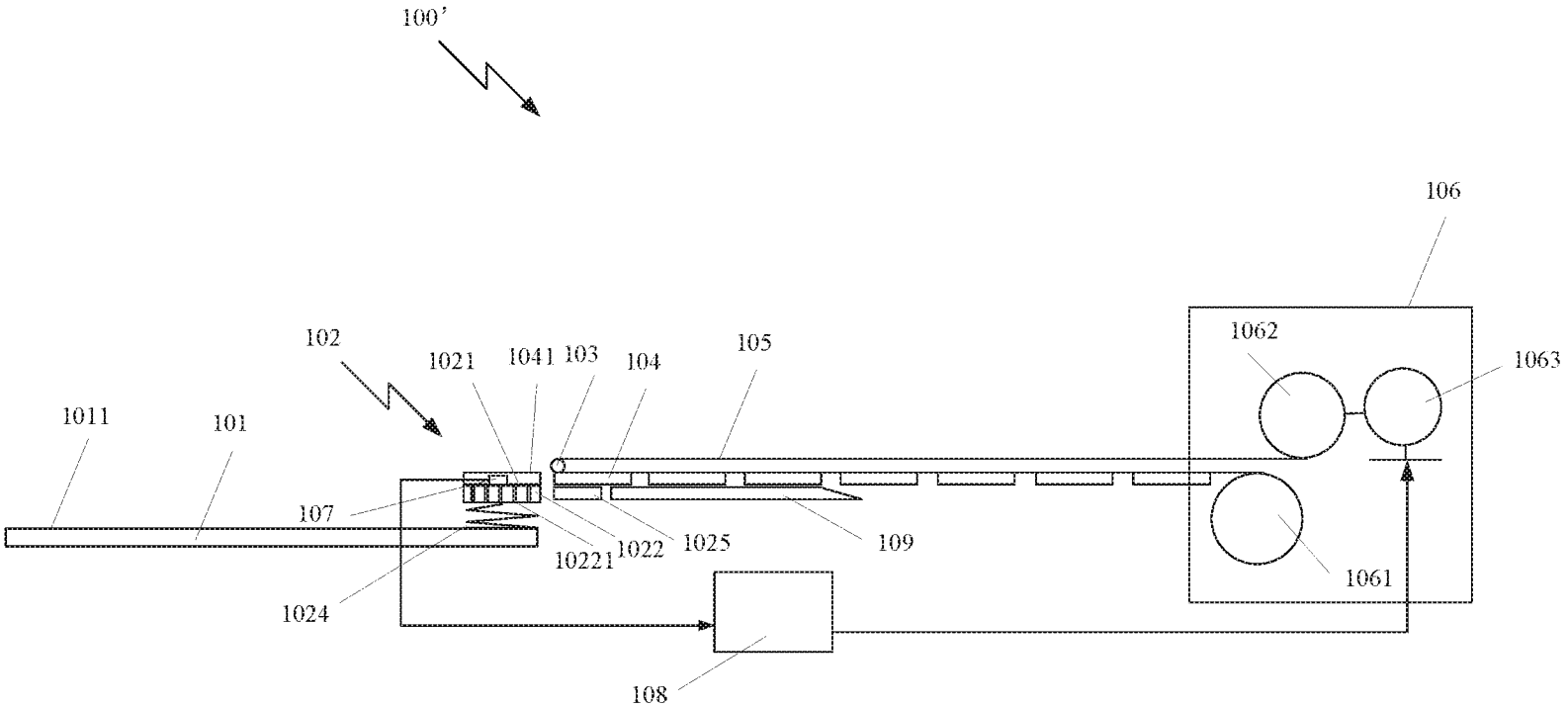
FIG. 2 shows a schematic structural view of an automatic labeling apparatus according to another embodiment of the present disclosure.

Referring now to FIG. 2, there is shown a schematic structural view of an automatic labeling apparatus 100' according to another embodiment of the present disclosure.

As shown in FIG. 2, in such embodiments of the disclosure, the label top tray 1022 and the separation unit 103 are located above the attachment surface 1011. Accordingly, the apparatus 100' will not include a driver 1026 for driving the label top tray 1022, nor does it include the label retaining wall 1023. In addition, in various implementations of such embodiments of the present disclosure, the apparatus 100' may also include the same components as the apparatus 100 of the embodiments shown in FIG. 1, such as the conveying unit 106, the first detector 107, the first control module 108, and the like. For the sake of simplicity, no further details are made here.

In addition, in such embodiments of the present disclosure, the apparatus 100' and its components may be provided at one end of the attachment platform 101 in order to prevent the separation unit 103, the conveying unit 106, etc. from interfering with the labeling operation. Alternatively, after a label 104 is placed on the label top tray 1022, the conveying unit 106 and the separation unit 103 may be driven by a drive means (e.g., a rotary or linear drive means) to leave the work position, so as to make room for the attachment operation.

According to an exemplary embodiment of the present disclosure, the label top tray 1022 is provided with a plurality of positioning air holes 10221 thereon for holding an individual label 104 in place when the individual label 104 is on the label top tray 1022.

According to an exemplary embodiment of the present disclosure, the attachment unit 102 further includes left and right stoppers 1025 provided at the label entrance end of the label top tray 1022 and configured to position a label in a left and right direction (viewed from the advancing direction of the label).

As will be appreciated by those skilled in the art, although an exemplary composition and structure of the attachment unit 102 according to several exemplary embodiments of the present disclosure are described above, the attachment unit 102 may also have various other components and configurations, and any other composition and structure of the attachment unit 102 are within the spirit and scope of the present disclosure as long as it can achieve the attachment of an individual label 104 from the label receiving face 1021 to the product placed on the attachment surface 1011.

According to an exemplary embodiment of the present disclosure, the automatic labeling apparatus 100, 100' further includes a second detector configured to detect whether a label 104 is present in the label top tray 1022, and a second control module connected to the second detector and the motor 1063 for driving the conveying unit 106, and configured to control the motor 1063 to drive the conveying unit 106 so that a next label 104 is placed in the label top tray 1022 when the second detector detects no label present in the label top tray 1022. The second detector may be, for example, an infrared detector, and may be located, for example, near the label top tray. The motor 1063 may place the next label 104 in the label top tray 1022, for example, by driving the label base paper reclaiming wheel 1062 in the conveying unit 106. In the exemplary embodiment of the present disclosure, the second detector may be the same detector as the first detector 107 described above, and the second control module may be the same control module as the first control module 108 described above. Alternatively, the second detector may be a separate detector other than the first detector 107, and the second control module may also be a separate control module other than the first control module 108.

According to an exemplary embodiment of the present disclosure, the automatic labeling apparatus 100, 100' further includes a label support 109 configured to provide support during movement of a label 104.

According to an exemplary embodiment of the present disclosure, the automatic labeling apparatus 100, 100' further includes a label reader (not shown) configured to read information of the label.

According to an exemplary embodiment of the present disclosure, a reading port of the label reader is provided on the label receiving surface 1021.

After reading the information of the label attached (or will be attached) to the product, the label reader may store and transmit the information of the label in association with the product, the attachment platform and/or the operator, so that it is convenient to achieve quality management of products, attachment platforms and/or operators.

According to an exemplary embodiment of the present disclosure, the attachment platform 101 is an operating platform of an assembly jig, and the attachment surface 1011 is an operating surface of the operating platform.

The automatic labeling apparatus 100, 100' according to embodiments of the present disclosure has been described above with reference to the accompanying drawings. It is to be noted that the foregoing description is by way of example only and is not intended to be limiting of the disclosure. In other embodiments of the present disclosure, the automatic labeling apparatus 100, 100' may include more, fewer, or different modules, and the relationships of inclusion, connection, and function etc. between the modules may be different from those described and illustrated.

Figure 3:
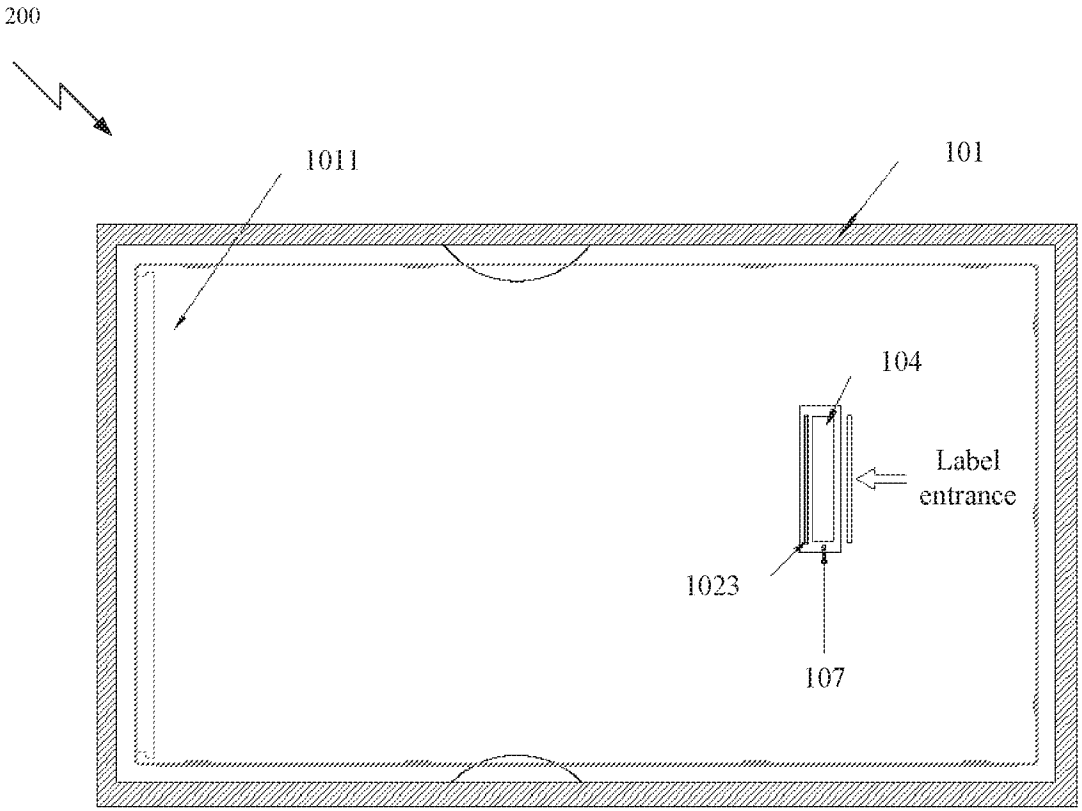
FIG. 3 shows a top view of an assembly jig according to an embodiment of the present disclosure.

Another aspect of the present disclosure provides an assembly jig including an automatic labeling apparatus according to any one of the preceding embodiments. FIG. 3 shows a top view of an assembly jig according to an embodiment of the present disclosure. As shown in FIG. 3, the assembly jig 200 includes an automatic labeling apparatus 100, 100' according to any one of the above-described embodiments of the present disclosure. The assembly jig 200 includes an operating platform 101 for assembling a product thereon, the operating platform having an operating surface 1011. The operating platform 101 is an attachment platform 101 of the automatic labeling apparatus 100, 100' according to an embodiment of the present disclosure, and the operating surface 1011 is the attachment surface 1011 of the attachment platform 101. There is a label entrance on the operating surface 1011, a label retaining wall 1023, and a detector 107 can be seen at the label entrance. In FIG. 3, the automatic labeling apparatus 100, 100' is located below the operating platform 101, so that the other modules of the automatic labeling apparatus 100, 100' are not shown. Of course, the automatic labeling apparatus 100, 100' may also be located above the operating platform 101.

Since the assembly jig includes an automatic labeling apparatus, this enhances the existing assembly jig in that a label can be automatically attached while assembling the product, and a simple and low-cost labeling apparatus is implemented, while the labels that are automatically attached can also be traced back to the quality of operation of each assembly staff.

Another aspect of the present disclosure provides an automatic labeling method. The automatic labeling method may be accomplished by the above-described automatic labeling apparatus according to an embodiment of the present disclosure, that is, the steps of the automatic labeling method may correspond to the operations of the modules of the automatic labeling apparatus. For the sake of brevity, partial details repeated with the above description are omitted from the following description, and a more detailed understanding of the automatic labeling method can be obtained by referring to the above description.

Figure 4:
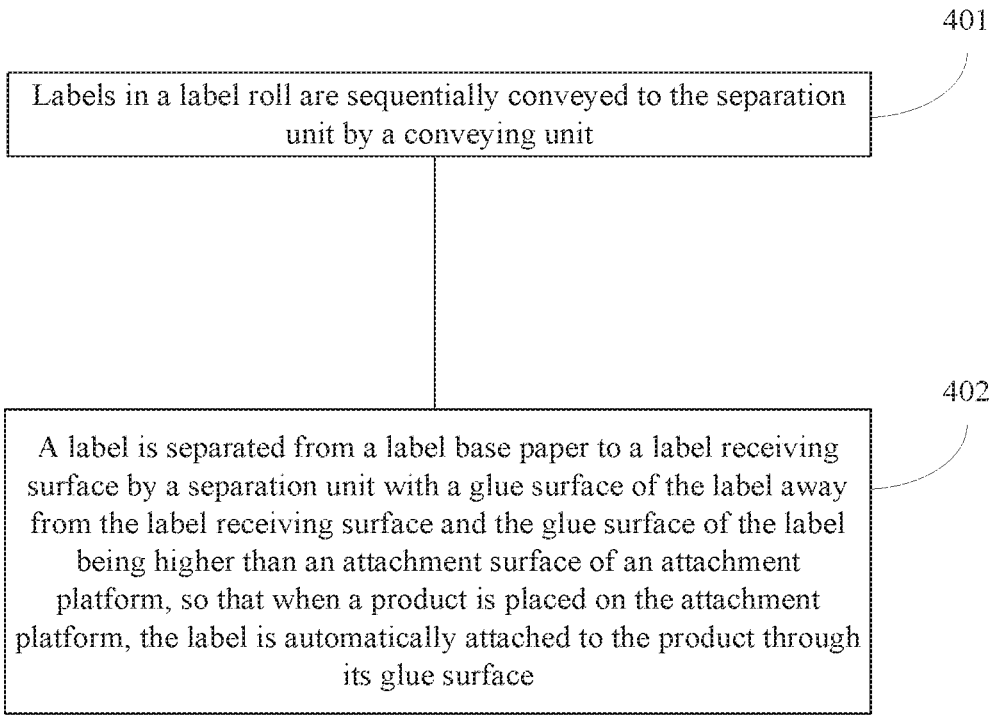
FIG. 4 shows an automatic labeling method according to an embodiment of the present disclosure.

Referring now to FIG. 4, there is shown an automatic labeling method according to an embodiment of the present disclosure. As shown, the method includes the following step:

In step 402, a label is separated from a label base paper to a label receiving surface by a separation unit with a glue surface of the label away from the label receiving surface and the glue surface of the label being higher than an attachment surface of an attachment platform, so that when a product is placed on the attachment platform, the label is automatically attached to the product through its glue surface.

According to an exemplary embodiment of the present disclosure, the automatic labeling method further includes the following optional step:

In step 401, labels in a label roll are sequentially conveyed to the separation unit by a conveying unit.

According to an exemplary embodiment of the present disclosure, the step 401 of conveying labels in a label roll sequentially to the separation unit by a conveying unit includes reclaiming a label base paper of a label roll mounted on a label roll turning wheel by a label base paper reclaiming wheel by rotation, and conveying labels in the label roll to the separation unit sequentially.

According to an exemplary embodiment of the present disclosure, separating a label from a label base paper to a label receiving surface by a separation unit includes causing the label base paper on the label roll to turn back by a label base paper baffle when the label base paper reclaiming wheel rotates, so that an individual label is separated from the label base paper to the label receiving surface.

According to an exemplary embodiment of the present disclosure, the label receiving surface is provided on a label top tray.

According to an exemplary embodiment of the present disclosure, the automatic labeling method further includes a step of supporting the label top tray by a spring located below the label top tray.

According to an exemplary embodiment of the present disclosure, the label top tray and the separation unit are located below the attachment surface, and the automatic labeling method further includes the following optional steps: controlling a driver for driving the label top tray to raise the label top tray so that the glue surface of the label in the label top tray is higher than the attachment surface when detecting a label present in the label top tray, and controlling the driver for driving the label top tray to lower the label top tray so as to receive a next label when detecting no label in the label top tray.

According to a further exemplary embodiment of the present disclosure, the automatic labeling method further includes the following optional step: stopping further movement of an individual label by a label retaining wall disposed near the label top tray after the individual label is separated from the label base paper.

According to another exemplary embodiment of the present disclosure, the label top tray and the separation unit are located above the attachment surface.

According to an exemplary embodiment of the present disclosure, the automatic labeling method further includes the following optional step: holding an individual label in place when the individual label is on the label top tray by a plurality of positioning air holes provided on the label top tray.

According to an exemplary embodiment of the present disclosure, the automatic labeling method further includes the following optional step: positioning a label in a left and right direction by left and right stoppers provided at the label entrance end of the label top tray.

According to an exemplary embodiment of the present disclosure, the automatic labeling method further includes the following optional steps: detecting whether a label is present in the label top tray, and controlling a motor for driving a conveying unit to drive the conveying unit to place a next label in the label top tray by a control module connected to the motor when detecting no label present in the label top tray.

According to an exemplary embodiment of the present disclosure, the automatic labeling method further includes the following optional step: reading information of the label by a label reader.

According to an exemplary embodiment of the present disclosure, the attachment platform is an operating platform of an assembly jig, the attachment surface being an operating surface of the operating platform.

The automatic labeling method according to embodiments of the present disclosure has been described above with reference to the accompanying drawings, and it is to be noted that the above description is by way of example only and is not intended to limit the present disclosure. In other embodiments of the present disclosure, the method may have more, fewer or different steps, and the relationships of order, inclusion, and function etc. between the steps may be different from what has been described and illustrated.

Another aspect of the present disclosure provides an assembly method including an automatic labeling method according to any one of the above embodiments.

It is to be understood that the above embodiments of the present disclosure are merely exemplary embodiments for explaining the principles of the present disclosure, and the present disclosure is not limited thereto. It will be apparent to those skilled in the art that various changes and modifications can be made therein without departing from the spirit and spirit of the disclosure, which are also intended to be within the scope of the present disclosure. The scope of the disclosure is defined only by the meaning of the language expression of the appended claims and their equivalents.

What is claimed is:

1. An automatic labeling apparatus comprising:

an attachment platform provided with an attachment surface;

an attachment unit provided with a label receiving surface;

a separation unit, wherein the separation unit is configured to transfer a label from a label base paper to the label receiving surface with a glue surface of the label away from the label receiving surface, the label receiving surface configured to position the glue surface of the label higher than the attachment surface when the label is on the label receiving surface; and a label top tray on which the label receiving surface is provided for receiving an individual label.

2. The apparatus according to claim 1, further comprising:

a conveying unit configured to sequentially convey labels in a label roll to the separation unit.

3. The apparatus according to claim 2, wherein the conveying unit comprises:

a label roll turning wheel configured to be mounted with a label roll and to be driven to rotate; and a label base paper reclaiming wheel configured to reclaim the label base paper of the label roll by rotation, and configured to convey labels in the label roll to the separation unit sequentially.

4. The apparatus according to claim 3, wherein the separation unit is configured to cause the label base paper on the label roll to turn back when the label base paper reclaiming wheel rotates, so that an individual label is transferred from the label base paper to the label receiving surface.

5. The apparatus according to claim 1, wherein the attachment unit further comprises:

a spring located below the label top tray and configured to support the label top tray.

6. The apparatus according to claim 1, wherein the label top tray and the separation unit are located below the attachment surface, and the apparatus further comprises:

a first detector configured to detect whether the label is present in the label top tray; and a first control module connected to the first detector and a driver for driving the label top tray, and configured to:

control the driver for driving the label top tray to raise the label top tray so that the glue surface of the label in the label top tray is higher than the attachment surface when the first detector detects the label is present in the label top tray; and control the driver for driving the label top tray to lower the label top tray so as to receive a next label when the first detector detects no label in the label top tray.

7. The apparatus according to claim 6, further comprising:

a label retaining wall disposed near the label top tray and configured to stop further movement of the label after the label is separated from the label base paper.

8. The apparatus according to claim 1, wherein the label top tray and the separation unit are located above the attachment surface.

9. The apparatus according to claim 1, wherein the label top tray is provided with a plurality of positioning air holes thereon for holding the label in place when the label is on the label top tray.

10. The apparatus according to claim 1, wherein the attachment unit further comprises:

left and right stoppers provided at the label entrance end of the label top tray, and configured to position the label in a left and right direction.

11. The apparatus according to claim 1, further comprising:

a second detector configured to detect whether the label is present in the label top tray;

a second control module connected to the second detector and the motor for driving the conveying unit, and configured to control the motor to drive the conveying unit so that a next label is placed in the label top tray when the second detector detects no label present in the label top tray.

12. The apparatus according to claim 1, further comprising:

a label support configured to provide support during movement of the label.

13. The apparatus according to claim 1, further comprising:

a label reader configured to read information on the label.

14. The apparatus according to claim 13, wherein a reading port of the label reader is provided on the label receiving surface.

15. The apparatus according to claim 1, wherein the attachment platform is an operating platform of an assembly jig, the attachment surface being an operating surface of the operating platform.

16. An assembly jig, comprising an automatic labeling apparatus according to claim 1.

17. An automated labeling method, comprising:

transferring a label from a label base paper to a label receiving surface using a separation unit such that a glue surface of the label faces away from the label receiving surface and is positioned higher than an attachment surface of an attachment platform, such that when a product is placed on the attachment platform, the label is automatically attached to the product using the glue surface, wherein the label receiving surface is provided on a label top tray.

18. The method according to claim 17, further comprising conveying labels in a label roll sequentially to the separation unit by a conveying unit, wherein conveying labels in a label roll sequentially to the separation unit by a conveying unit comprises:

reclaiming a label base paper of a label roll mounted on a label roll turning wheel by rotating a label base paper reclaiming wheel, and conveying labels in the label roll to the separation unit sequentially.

19. The method according to claim 18, wherein transferring a label from a label base paper to a label receiving surface using a separation unit comprises:

using the separation unit to cause the label base paper on the label roll to turn back when the label base paper reclaiming wheel rotates, such that the individual label is transferred from the label base paper to the label receiving surface.

* * * * *